United States Patent [19]

Bakker et al.

[11] Patent Number: 4,580,077

[45] Date of Patent: Apr. 1, 1986

[54] DISPLAY TUBE HAVING A DISPLAY WINDOW WITH SHARPLY CURVED SKIRT PORTION

[75] Inventors: Gijsbertus Bakker; Gerhardus J. Rorije, both of Eindhoven, Netherlands

[73] Assignee: U.S. Philips Corporation, New York, N.Y.

[21] Appl. No.: 607,323

[22] Filed: May 4, 1984

[30] Foreign Application Priority Data

Dec. 6, 1983 [NL] Netherlands ..... 8304180

[51] Int. Cl.[4] ..... H01J 31/00

[52] U.S. Cl. ..... 313/477 R; 313/474; 220/2.1 A; 358/225

[58] Field of Search ..... 313/461, 474, 477 R, 313/478; 220/2.1 A, 2.3 A; 358/225

[56] References Cited

U.S. PATENT DOCUMENTS 3,089,052 4/1965 Bisbing ..... 220/2.1 A

*Primary Examiner*—David K. Moore
*Assistant Examiner*—William L. Oen
*Attorney, Agent, or Firm*—Robert J. Kraus

[57] ABSTRACT

A display tube comprising an envelope consisting of a neck, a cone, and a faceplate including a flat or slightly curved, substantially rectangular display window and a skirt which is substantially parallel to the axis of the envelope. The skirt and the display window meet at a sharply-curved transition portion of the faceplate. The display window has on its inside a substantially rectangular display screen. The display window and the skirt near the sharply curved portion and over the whole circumference of the display window have a thickness d which to an approximation satisfies the following relationship:

$$d = C\,D^{0.8}\,R^{0.2}$$

wherein

C is a constant between 0.015 and 0.025,

D is the diagonal of the inner surface of the display window, and

R is the radius of the curvature of the inner surface of the display window.

The tube is implosion-safe and the faceplate has a narrow dark edge which is equally wide substantially everywhere around the display screen.

3 Claims, 5 Drawing Figures

DISPLAY TUBE HAVING A DISPLAY WINDOW WITH SHARPLY CURVED SKIRT PORTION

BACKGROUND OF THE INVENTION

The invention relates to a display tube comprising an envelope consisting of a neck, a cone and a faceplate including flat or slightly curved, substantially rectangular display window and a skirt which is substantially parallel to the axis of the envelope. The skirt and the display window meet at a sharply curved transition portion of the faceplate. The display window has on its inside a substantially rectangular display screen, and the tube includes means in the neck to generate at least one electron beam.

The invention also relates to a picture display device comprising such a display tube.

Such a display tube may be a colour display tube. In that case the display screen usually comprises a pattern of triplets of luminescent stripes or dots of a luminescent material luminescing in three different colours. However, it is also possible for the display tube to be a display tube for displaying monochromatic pictures, such as a tube for displaying letters, digits, characters and figures, a so-called D.G.D.-tube (Data Graphic Display).

Recently developed display tubes have flatter display windows, as is described in the Journal of Electronic Engineering, August 1982, p. 24. The colour display tube described has a substantially rectangular display window in which, however, the outer contour of the skirt and display window is slightly barrel-shaped. Such a slightly barrel-shaped outer contour is assumed to be necessary to meet the stringent safety requirements protecting against implosion of the tube. For tubes which are placed in a cabinet and the outer contour of which is concealed from the viewer by a bezel, the barrel-shaped contour need not be a disadvantage because the inner edge of the benzel can adjoin the edge of the rectangular display screen. However, for tubes the display window of which slightly projects outside the cabinet (so-called "push-through" mounting) and hence the benzel cannot be used, the substantially rectangular display screen on the inner wall of the much less rectangular faceplate expose to dark areas above and below and on the left and on the right of the displayed picture, which areas vary in width and are annoying to the viewer.

SUMMARY OF THE INVENTION

It is an object of the invention to provide an anti-implosion display tube which is particularly suitable for "push-through" mounting and which does not exhibit the above-mentioned disturbing dark areas.

According to the invention, a display tube of the kind mentioned in the opening paragraph is characterized in that the display window and the skirt near the sharply curved transition portion of the faceplate, and over the whole circumference of the display window have a thickness d which to an approximation satisfies the following relationship:

$$d = CD^{0.8}R^{0.2}$$

wherein

C is a constant between 0.015 and 0.025 D is the diagonal of the inner surface of the display window, and R is the radius of curvature of the inner surface of the display window.

for $C<0.015$ the tube becomes too weak and is no longer implosion-safe. For $C>0.025$ the tube wall becomes too thick and the tube becomes too heavy and hence is difficult to handle.

Experiments and comparative calculations have demonstrated that a display tube having a substantially rectangular outer contour, in which the above relationship is satisfied, does not lose its implosion safety under either dynamic or static loads, as compared with the known tube which has a substantially flat display window and a barrel-shaped contour.

Moreover, by using the invention, only a narrow, dark edge which is usually wide substantially everywhere and which even emphasises the rectangularity of the display screen is obtained around the rectangular display screen. Moreover, the narrow, dark edge which is equally wide substantially everywhere, during operation of the tube leads to a picture presentation which is attractive to the viewer. Notably, this edge does not lead to a perceptive distortion of, for example, a number of straight columns of digits displayed on the display screen. In a tube which is not in operation the narrow edge which is equally wide substantially everywhere around the display screen leads to an aesthetic design.

BRIEF DESCRIPTION OF THE DRAWING

The invention will now be described in greater detail, by way of example, with reference to a drawing, in which.

DESCRIPTION OF THE PREFERRED EMBODIMENT

Figure 1:
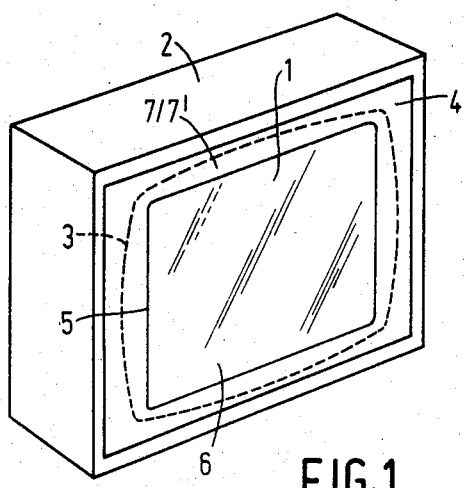
FIG.1 PRIOR ART
FIG. 1 is a perspective view of a prior art television set having a fillet around the display window.

FIG. 1 is a perspective view of a prior art television set. A display tube having a display window 1 is connected in a cabinet 2 by means of suspension means not shown. The tube comprises a substantially rectangular display screen 6 on the inner surface of the much less rectangular display window 1 which has a slightly barrel-shaped outer contour 3 (broken line). As a result of this a dark edge varying in width is formed around the display screen 6 and is covered by a bezel 4. The inner edge 5 of the bezel forms for the viewer the visual boundary of the luminescing material of the display screen 6 on the inner wall of the display window 1.

Figure 2:
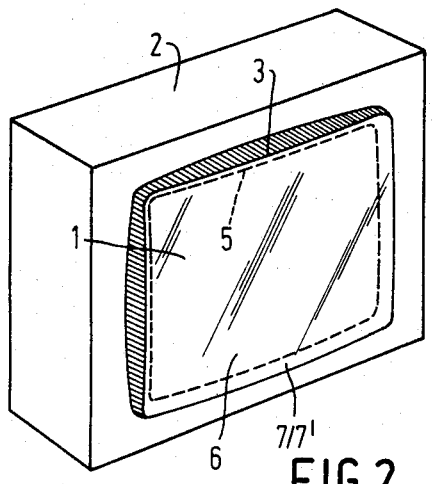
FIG.2 PRIOR ART
FIG. 2 shows a prior art set without a fillet but with push-through mounting of the display tube.
Figure 3:
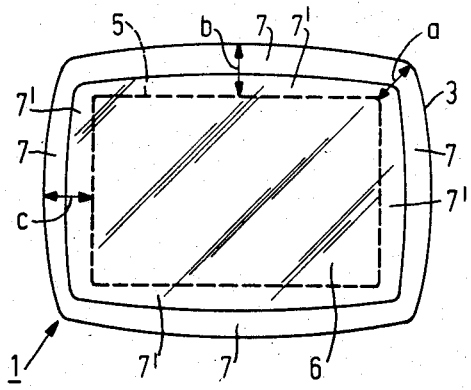
FIG.3 PRIOR ART
FIG. 3 is a front elevation of the display tube of the set shown in FIG. 2.

FIG. 2 is a perspective view of a television set in which a display tube of the type as used in the FIG. 1 set is used. In this set the display window 1 slightly projects from the cabinet 2. This is the so-called push-through mounting of the display tube. In this method of tube mounting, the use of the bezel 4 described with reference to FIG. 1 is not possible. The substantially rectangular display screen 6 bounded by the broken line on the inner wall of the much less rectangular display window 1 leads to dark or shining areas 7, 7' above and below and on the left and on the right of the displayed picture, which areas vary in width and are annoying to the viewer. The areas 7 and 7' are dark in the case of a matrix tube and are partly shining (area 7') in the case of a tube in which no matrix material is used, so that the aluminium present beyond the boundary of the luminescent material is visible. This is shown more clearly in FIG. 3 which is a front elevation of the tube as used in the FIG. 2 set. In a tube having a outside diagonal of the substantially rectangular display window of 51 cm, the spacing from the boundary 5 of the display screen 6 (broken line in the Figure) to the outer contour of the display window in the diagonal direction was 18.3 mm (indicated by an arrow a) and on the centres of the long and the short sides it was 26.6 mm (indicated by an arrow b) and 23.8 mm (indicated by an arrow c), respectively.

Figure 4:
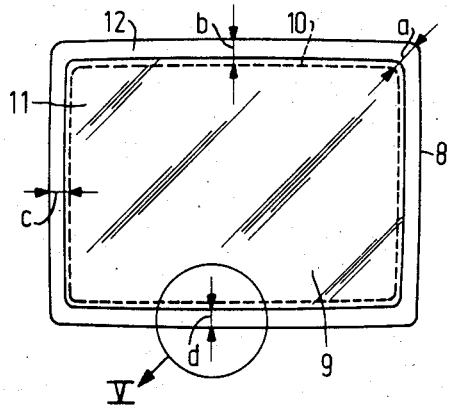
FIG. 4 is a front elevation of a display tube according to the invention.

FIG. 4 is a front elevation of a display tube according to the invention in which the outer circumference of the display window 9 is substantially parallel to the boundary 10 of the luminescent material of the display screen 11. As a result of this, a dark edge 12 of uniform width surrounding the substantially rectangular display screen is obtained. By giving the display window and the skirt near the sharply curved transition portion and over the whole circumference of the display window a thickness d which to an approximation satisfies the relationship $$d = CD^{0.8}R^{0.3} \quad (1)$$

wherein C is a constant between 0.015 and 0.025

D is the diagonal of the inner surface of the display window, and

R is the radius of curvature of the inner surface of the display window, an implosion-safe tube is obtained.

The values of a, b and c for the tube shown in FIG. 4 are 19.5, 20.9 and 20.0 mm, respectively. Thus, tube according to the invention the variation in the width of the dark edge is less than 1.5 mm, which is hardly visible. In the prior art tube of FIG. 3, the variation is well over 8 mm, which perceptively causes an annoying effect. The sides of the outer circumference 8 have a radius of curvature of approximately 6.5 m.

Figure 5:
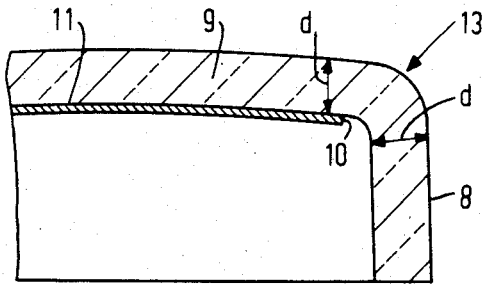
FIG. 5 is a sectional view of the edge of a display window of the tube shown in FIG. 4.

FIG. 5 shows for illustration a cross-sectional view of the edge of the display window of the FIG. 4 tube. The thickness of the display window 9 and the skirt 8 on each side of the sharply curved transition portion 13 is equal to d, which is defined by relationship (1) described hereinbefore. For example, the thickness is 14.8 mm for a tube in which D=590 mm, R=1460 mm and a value of the constant C of 0.021. For example, for a tube in which D=510 mm, R=1350 mm and for a value of the constant C of 0.021, the thickness is 13.5 mm.

For further information reference is made to the Netherlands Patent Application Nos. 8304178, 8304179, and 8304181 corresponding to U.S. patent application Ser. Nos. 607,321, 607,359 and 607,328, which were filed simultaneously with the present application and which may be considered to be incorporated by reference.

What is claimed is:

1. A display tube comprising an envelope including a neck, a cone, and a faceplate having a substantially flat display window with an inner surface bearing a rectangular luminescent screen and having a rectangular skirt with substantially linear sides extending from a sharply-curved transition portion of said faceplate where the skirt meets the display window; the display window and the skirt, in the vicinity of the transition portion, having at least a thickness d which has an approximate value defined by the equation $$d \sim CD^{0.8}R^{0.2}, \text{ where:}$$

C is a constant having a value from 0.015 to 0.025,

D is the diagonal of the inner surface of the display window, and

R is the radius of curvature of the inner surface of the display window.

2. A display tube as in claim 1 where the sides of the skirt have a minimum radius of curvature of approximately 6.5 meters.

3. A picture display device including a cabinet having an opening through which protrudes a display tube faceplate, said faceplate having a substantially flat display window with an inner surface bearing a rectangular luminescent screen and having a rectangular skirt with substantially linear sides extending from a sharply-curved transition portion of said faceplate where the skirt meets the display window; the display window and the skirt, in the vicinity of the transition portion, having at least a thickness d which has an approximate value defined by the equation $d \sim CD^{0.8}R^{0.2}$, where:

C is a constant having a value from 0.015 to 0.025,

D is the diagonal of the inner surface of the display window, and

R is the radius of curvature of the inner surface of the display window.

* * * * *